US009659549B2

(12) United States Patent
Ohba et al.

(10) Patent No.: US 9,659,549 B2
(45) Date of Patent: May 23, 2017

(54) SUPPORT ASSEMBLY AND KEYBOARD APPARATUS

(71) Applicant: Yamaha Corporation, Hamamatsu-shi, Shizuoka-ken (JP)

(72) Inventors: Akito Ohba, Hamamatsu (JP); Ichiro Osuga, Hamamatsu (JP); Shunsuke Ichiki, Hamamatsu (JP); Hiroshi Harimoto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/217,351

(22) Filed: Jul. 22, 2016

(65) Prior Publication Data

US 2017/0025100 A1 Jan. 26, 2017

(30) Foreign Application Priority Data

Jul. 23, 2015 (JP) ..... 2015-145709

(51) Int. Cl.
*G10C 3/18* (2006.01)
*G10C 3/16* (2006.01)
*G10C 3/22* (2006.01)

(52) U.S. Cl.
CPC ..... *G10C 3/168* (2013.01); *G10C 3/22* (2013.01)

(58) Field of Classification Search
CPC ..... G10C 3/168; G10C 3/22
USPC ..... 84/744, 745, 236, 434
See application file for complete search history.

(56) References Cited

U.S. PATENT DOCUMENTS 5,557,052 A * 9/1996 Hayashida ..... G10C 3/16 84/221
6,362,412 B1 * 3/2002 Ura ..... G10H 1/344 73/488
6,423,889 B2 * 7/2002 Inoue ..... G10C 3/22 84/171
2002/0121183 A1 * 9/2002 Inoue ..... G10O 5/005 84/719
2005/0005758 A1 * 1/2005 Yoshisue ..... G10C 3/22 84/236
2005/0028665 A1 * 2/2005 Tanaka ..... G10C 3/24 84/236
2005/0045016 A1 * 3/2005 Yoshisue ..... G10C 3/18 84/251
2009/0173206 A1 * 7/2009 Inoue ..... G10C 3/22 84/243
2014/0013922 A1 * 1/2014 Fandrich ..... G10C 3/161 84/242

FOREIGN PATENT DOCUMENTS

JP 2005-292361 A 10/2005

* cited by examiner

*Primary Examiner* — Jeffrey Donels
(74) *Attorney, Agent, or Firm* — Crowell & Moring LLP

(57) ABSTRACT

A support assembly of a keyboard apparatus activated in accordance with pressing of a key to rotate a hammer provided at one end of a hammer shank, the support assembly includes a support rotatably disposed with respect to a frame, a jack having one side rotatably connected to the support and another side including a contact surface which makes contact with a hammer shank roller provided to the hammer shank, and a rib provided to the other side of the jack and projecting to a hammer shank roller side of the contact surface.

17 Claims, 11 Drawing Sheets

SUPPORT ASSEMBLY AND KEYBOARD APPARATUS

CROSS REFERENCE TO RELATED APPLICATIONS

This application is based upon and claims the benefit of priority from the prior Japanese Patent Application No. 2015-145709, filed on Jul. 23, 2015, the entire contents of which are incorporated herein by reference.

FIELD

Embodiments of the present invention relates to a support assembly for use in a keyboard apparatus.

BACKGROUND

Conventional acoustic pianos such as grand pianos and upright pianos are made up by many components. Since assembling these components is very complex, the assembling operation takes long time. In particular, since an action mechanism provided correspondingly to each key requires many components, its assembling operation is very complex.

For example, in an action mechanism described in Japanese Unexamined Patent Application Publication No. 2005-292361, a plurality of components acts each other, and key operation by key pressing and key releasing is transmitted to a hammer. In particular, a support assembly configuring part of the action mechanism operates with various components assembled together. The support assembly has not only a mechanism which achieves string hammering by the hammer in accordance with key pressing but also an escapement mechanism for releasing a force transmitted to the hammer by key operation immediately before string hammering. This mechanism is an important mechanism for achieving basic operation of the acoustic piano. In particular, in a grand piano, a double escapement mechanism having a repetition lever and a jack combined together is generally adopted.

The operation of the action mechanism provides a sense (hereinafter referred to as a touch feeling) to a finger of a player through a key. In particular, the structure of the support assembly provides an important influence on the touch feeling. For example, the touch feeling by the operation of the escapement mechanism is called let-off.

SUMMARY

A support assembly of a keyboard apparatus activated in accordance with pressing of a key to rotate a hammer provided at one end of a hammer shank, the support assembly includes a support rotatably disposed with respect to a frame, a jack having one side rotatably connected to the support and another side including a contact surface which makes contact with a hammer shank roller provided to the hammer shank, and a rib provided to the other side of the jack and projecting to a hammer shank roller side of the contact surface.

A keyboard apparatus includes support assemblies each activated in accordance with pressing of a key to rotate a hammer provided at one end of a hammer shank, and keys disposed correspondingly to the respective support assemblies. Each of the support assemblies including a support rotatably disposed with respect to a frame, a jack having one side rotatably connected to the support and having another side including a contact surface which makes contact with a hammer shank roller provided to the hammer shank, and a rib provided to the other side of the jack and projecting to a hammer shank roller side from the contact surface.

REFERENCE SIGNS LIST

Figure 1:
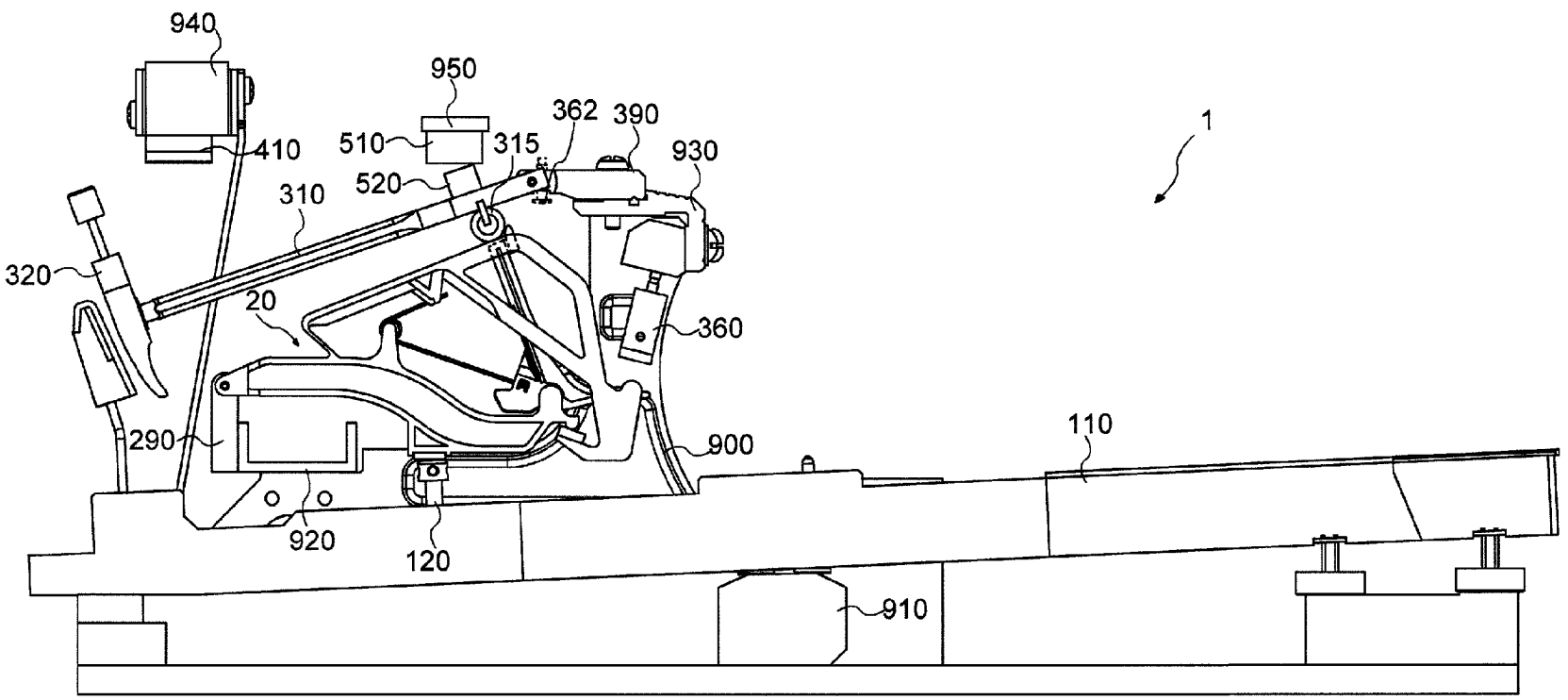
FIG. 1 is a side view depicting the structure of a keyboard apparatus in one embodiment of the present invention.

1, 2 . . . keyboard apparatus, 20, 60 . . . support assembly, 50 . . . sound emission mechanism, 110 . . . key, 120 . . . capstan screw, 210, 610 . . . support, 2105 . . . jack support portion, 2109 . . . through hole, 212, 612 . . . support heel, 216 . . . stopper, 218 . . . spring support portion, 220 . . . flexible portion, 240, 640 . . . repetition lever, 242 . . . spring contact portion, 244, 644 . . . extension, 2441 . . . inner portion, 2442 . . . outer portion, 2443 . . . coupling portion, 2444 . . . stopper contact portion, 2445 . . . first contact portion, 2446 . . . second contact portion, 250, 650 . . . jack, 2502, 6502 . . . large jack, 2504, 6504 . . . small jack, 2505, 6505 . . . support connecting portion, 2506, 6506 . . . rib, 2508 . . . projecting portion, 2562 . . . spring contact portion, 280 . . . torsion coil spring, 2802 . . . first arm, 2804 . . . second arm, 290 . . . support flange, 310 . . . hammer shank, 315 . . . hammer shank roller, 320 . . . hammer, 360 . . . regulating button, 390 . . . shank flange, 410 . . . hammer stopper, 510 . . . sensor, 520 . . . shielding plate, 550 . . . signal converting unit, 560 . . . sound source unit, 570 . . . output unit, 642, 6442, 6444 . . . slit, 660 . . . operation regulating unit, 680 . . . coil spring, 632 . . . frame fixing portion, 634, flexible portion, 638 . . . base, 6382 . . . large-jack stopper, 648 . . . support fixing portion, 666 . . . guide, 662 . . . extension, 900 . . . bracket, 910 . . . balance rail, 920, 960 . . . support rail, 930 . . . shank rail, 940 . . . hammer stopper rail, 950 . . . sensor rail

DESCRIPTION OF EMBODIMENTS

In the following, a keyboard apparatus including a support assembly in one embodiment of the present invention is described in detail with reference to the drawings. Embodiments described below are merely examples of embodiments of the present invention, and the present invention should not be interpreted to be restricted to these embodiments. Note that, in the drawings referred to in the present embodiments, identical portions or portions having a similar function are provided with a same sign or similar sign (sign with a numeral merely followed by "a", "b", or the like), and repetitive description thereof may be omitted. Also, for convenience of description, the dimensional ratios in the drawings (such as ratios between respective structures, or length ratios) may differ from actual ratios, and parts of the structure may be omitted from the drawings.

Since the support assembly in the keyboard apparatus has many components, the manufacturing period is prolonged and manufacturing costs are high. Therefore, to reduce manufacturing costs, it is desirable to decrease the number of components and simplify the structure. However, even if the structure of the support assembly is changed, the touch feeling at the time of key operation is desired to be not greatly changed. Also, even if the number of components is decreased to simplify the structure, the support assembly is desired to stably operate by following key pressing.

One embodiment of the present invention described below relates to a support assembly and keyboard apparatus capable of decreasing a change in touch feeling at the time of key operation, achieving stabilization of operation, and reducing manufacturing costs, compared with a keyboard apparatus for an acoustic piano.

First Embodiment

Structure of Keyboard Apparatus 1

A keyboard apparatus 1 in one embodiment of the present invention is an example obtained by applying one example of the support assembly according to one embodiment of the present invention to an electronic piano. To obtain a touch feeling close to a grand piano at the time of key operation, this electronic piano includes a structure similar to a support assembly included in the grand piano. By using FIG. 1, a general outline of the keyboard apparatus 1 according to one embodiment of the present invention is described.

FIG. 1 is a side view depicting a mechanical structure of the keyboard apparatus according to one embodiment of the present invention. As depicted in FIG. 1, the keyboard apparatus 1 according to one embodiment of the present invention includes a plurality of keys 110 (in this example, eighty-eight keys) and an action mechanism corresponding to each of the keys 110. The action mechanism includes a support assembly 20, a hammer shank 310, a hammer 320, and a hammer stopper 410. Note that while FIG. 1 depicts the case in which the keys 110 are white keys, the keys may be black keys. Also, in the following description, terms representing orientations such as a player's forward side, a player's depth side, upward, downward, and sideward are defined as orientations when the keyboard apparatus is viewed from a player's side. For example, in the example of FIG. 1, the support assembly 20 is disposed on a player's forward side when viewed from the hammer 320, and is disposed upward when viewed from the key 110. Sideward corresponds to a direction in which the keys 110 are arranged.

The key 110 is rotatably supported by a balance rail 910. The key 110 rotates in a range from a rest position depicted in FIG. 1 to an end position. Here, "the rest position" is a key position when the key is not pressed, and the "end position" is a key position when the key is completely pressed down. The key 110 includes a capstan screw 120. The support assembly 20 is rotatably connected to a support flange 290, and is mounted on the capstan screw 120. The support flange 290 is fixed to a support rail 920. Detailed structure of the support assembly 20 will be described further below. Note that the support flange 290 and the support rail 920 are one example of a frame serving as a reference of rotation of the support assembly 20. The frame may be formed of a plurality of members, such as the support flange 290 and the support rail 920, or may be formed of one member. The frame may be, as with the support rail 920, a rail-shaped member with a long side in the arrangement direction of the keys 110, or may be, as with the support flange 290, an independent member for each key 110.

The hammer shank 310 is rotatably connected to a shank flange 390. The hammer shank 310 includes a hammer roller 315. The hammer shank 310 is mounted on the support assembly 20 via the hammer roller 315. The shank flange 390 is fixed to a shank rail 930. The hammer 320 is fixed to an end of the hammer shank 310. A regulating button 360 is fixed to the shank rail 930. The hammer stopper 410 is fixed to a hammer stopper rail 940 to be disposed at a position of regulating rotation of the hammer shank 310.

A sensor 510 is a sensor for measuring the position and moving speed (speed immediately before the hammer shank 310 collides with the hammer stopper 410) of the hammer shank 310. The sensor 510 is fixed to a sensor rail 950. In this example, the sensor 510 is a photo interrupter. In accordance with the amount of shielding the optical axis of the photo interrupter by a shielding plate 520 fixed to the hammer shank 310, an output value from the sensor 510 is changed. Based on this output value, the position and moving speed of the hammer shank 310 can be measured. Note that a sensor for measuring an operating state of the key 110 may be provided in place of the sensor 510 or together with the sensor 510.

The above-described support rail 920, shank rail 930, hammer stopper rail 940, and sensor rail 950 are supported by a bracket 900.

Structure of Support Assembly 20

Figure 2:
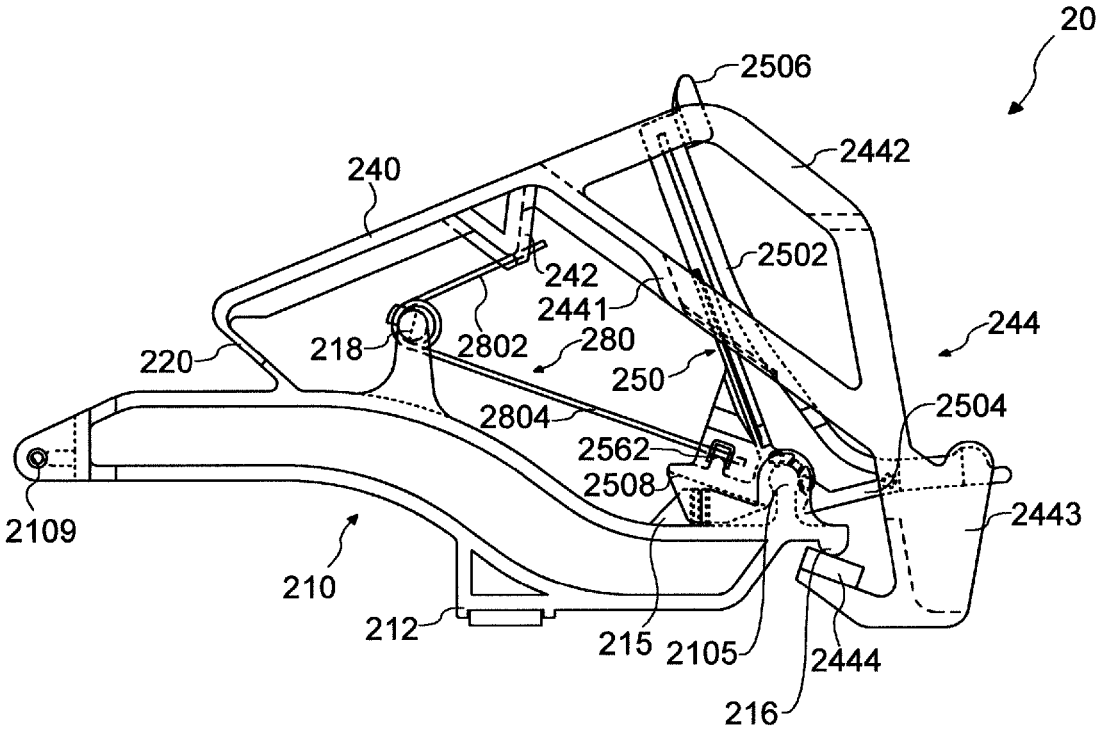
FIG. 2 is a side view depicting the structure of a support assembly according to one embodiment of the present invention.

FIG. 2 is a side view depicting the structure of the support assembly according to one embodiment of the present invention. The support assembly 20 includes a support 210, a repetition lever 240, a jack 250, and a torsion spring 280. The support 210 and the repetition lever 240 are coupled together via a flexible portion 220. By the flexible portion 220, the repetition lever 240 is rotatably supported with respect to the support 210. The support assembly 20, except the torsion coil spring 280 and cushioning materials or the like (such as nonwoven fabric or elastic material) provided at a portion which collides with another member, is a resin-made structure manufactured by injection molding or the like. In this example, the support 210 and the repetition lever 240 are integrally formed. Note that the support 210 and the repetition lever 240 may be formed as individual components and be attached or bonded together.

The support 210 has one end side where a through hole 2109 is formed, and has the other end side where a jack support portion 2105 is formed. Between the through hole 2109 and the jack support portion 2105, the support 210 includes a support heel 212 projecting downward and a spring support portion 218 projecting upward. Through the through hole 2109, a shaft supported by the support flange 290 is drawn. With this, the support 210 is rotatably disposed with respect to the support flange 290 and the support rail 920. Therefore, the through hole 2109 serves as a rotation center of the support 210.

The support heel 212 has its lower surface which makes contact with the above-described capstan screw 120. The spring support portion 218 supports the torsion coil spring 280. The jack support portion 2105 rotatably supports the jack 250. Therefore, the jack support portion 2105 serves as a rotation center of the jack 250.

Between the through hole 2109 (rotation center of the support 210) and the jack support portion 2105 (rotation center of the jack 250), a space is formed on a jack support portion 2105 side of the support heel 212. The jack support portion 2105 projects upward from the support 210. Also, at an end of the support 210, a stopper 216 couples. The support heel 212 is disposed below the support 210.

To the repetition lever 240, a spring contact portion 242 and an extension 244 are coupled. The spring contact portion 242 and the extension 244 extend from the repetition lever 240 toward a support 210 side. The spring contact portion 242 makes contact with a first arm 2802 of the torsion coil spring 280. The repetition lever 240 and the extension 244 include two plate-shaped members for interposition from sides of both side surfaces of the jack 250. In this example, the extension 244 and the jack 250 slidably make contact with each other in at least part of a space interposed between these two plate-shaped members.

The extension 244 includes an inner portion 2441, an outer portion 2442, a coupling 2443, and a stopper contact portion 2444. The inner portion 2441 is coupled in the repetition lever 240 on a player's depth side (flexible portion 220 side) of a large jack 2502. The inner portion 2441 interposes the large jack 2502 to cross to extend to a player's forward side (opposite side of the flexible portion 220) of the large jack 2502. That is, it can be said that the extension 244 crosses the jack 250. At a portion of interposing the large jack 2502, the inner portion 2441 may include a linear-shaped projecting portion projecting to a large jack 2502 side.

The outer portion 2442 is coupled in the repetition lever 240 on a player's forward side (opposite side to the flexible portion 220) of the jack 250 (large jack 2502). The inner portion 2441 and the outer portion 2442 are coupled together at the coupling portion 2443. The coupling portion 2443 interposes a small jack 2504. The stopper contact portion 2444 couples to the coupling portion 2443, and makes contact with the stopper 216 from below the stopper 216. According to this, the stopper 216 regulates a rotation range of the repetition lever 240 in a (upward) direction in which the repetition lever 240 and the support 210 spread. A guide portion 215 includes paired members projecting upward so as to interpose part of the jack 250 from the support 210.

The jack 250 includes the large jack 2502, the small jack 2504, and a projecting portion 2508. The jack 250 is rotatably disposed with respect to the support 210. Between the large jack 2502 and the small jack 2504, a support connecting portion 2505 to be rotatably supported by the jack support portion 2105 is formed. The support connecting portion 2505 has a shape surrounding part of the jack support portion 2105, and regulates a rotation range of the jack 250. Also, with the shape of the support connecting portion 2505 and elastic deformation of its material, the jack 250 can fit from above the jack support portion 2105. The projecting portion 2508 projecting from the large jack 2502 to a side opposite to the small jack 2504, and rotates with the jack 250. The projecting portion 2508 includes, on its side surface, a spring contact portion 2562. The spring contact portion 2562 makes contact with a second arm 2804 of the torsion coil spring 280.

The jack 250 has one side or end where the support connecting portion 2505 is provided to rotatably fit in the jack support portion 2105 of the support 210. On the other side or end (another way to describe the one side of the jack may be an "end"), the large jack 2502 is provided with a rib 2506. At a tip of the large jack 2502 on the other side, the jack 250 has a contact surface which makes contact with the hammer shank roller 315. The rib 2506 projects upward (hammer shank roller 315 side) of the contact surface where an upper end of the large jack 2502 makes contact with the hammer shank roller 315. While the tip of the large jack 2502 on the other side overlaps the outer portion 2442 of the extension 244, the rib 2506 projects upward from the outer portion 2442. Note that the rib 2506 is provided on the other side or end of the large jack 2502 and rotates together with the large jack 2502. The rib 2506 and the large jack 2502 may be integrally formed, or the rib 2506 may be prepared as a separate component and be attached to the large jack 2502.

Figure 3:
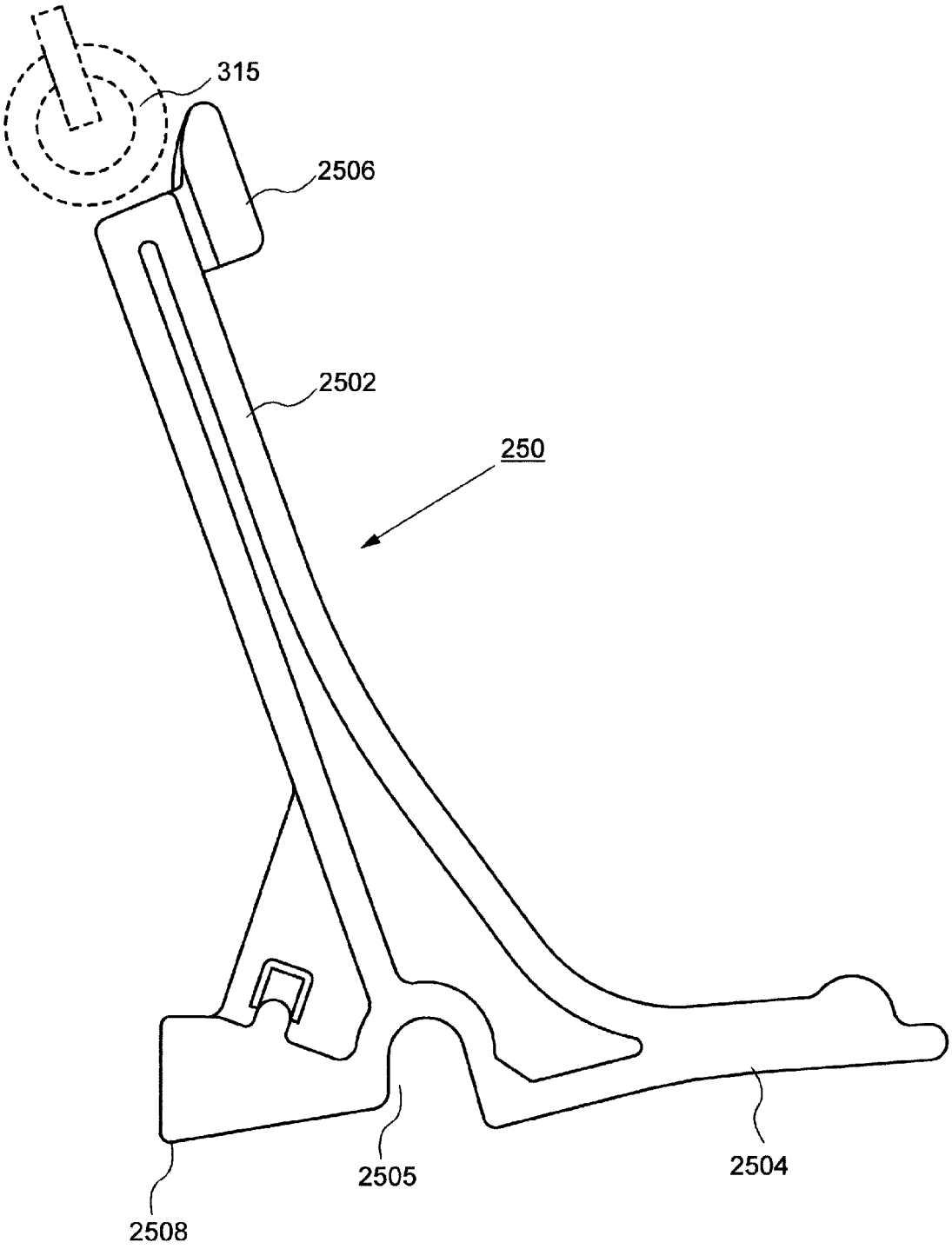
FIG. 3 is a side view depicting the structure of a jack according to one embodiment of the present invention.

FIG. 3 depicts the jack 250. The rib 2506, together with the tip of the large jack 2502, regulates the rotation range of the jack 250 by making contact with the hammer shank roller 315. In this sense, the rib 2506 can be regarded as a jack rotation stopper. The rib 2506 is preferably provided at one end of the large jack 2502 on a small jack 2504 side. In this mode, an upper end portion of the large jack 2502 and the rib 2506 can make contact with the hammer shank roller 315.

Note that the shape of the rib 2506 in the jack 250 is preferably formed so that a surface making contact with the hammer shank roller 315 is molded as a curved shape. FIG. 3 depicts a mode in which the rib 2506 has a convex-shaped curved shape with respect to the hammer shank roller 315. According to this shape, a contact area between the rib 2506 and the hammer shank roller 315 can be decreased. With this, friction between the rib 2506 and the hammer shank roller 315 can be reduced, and contact noise can also be reduced.

Figure 4:
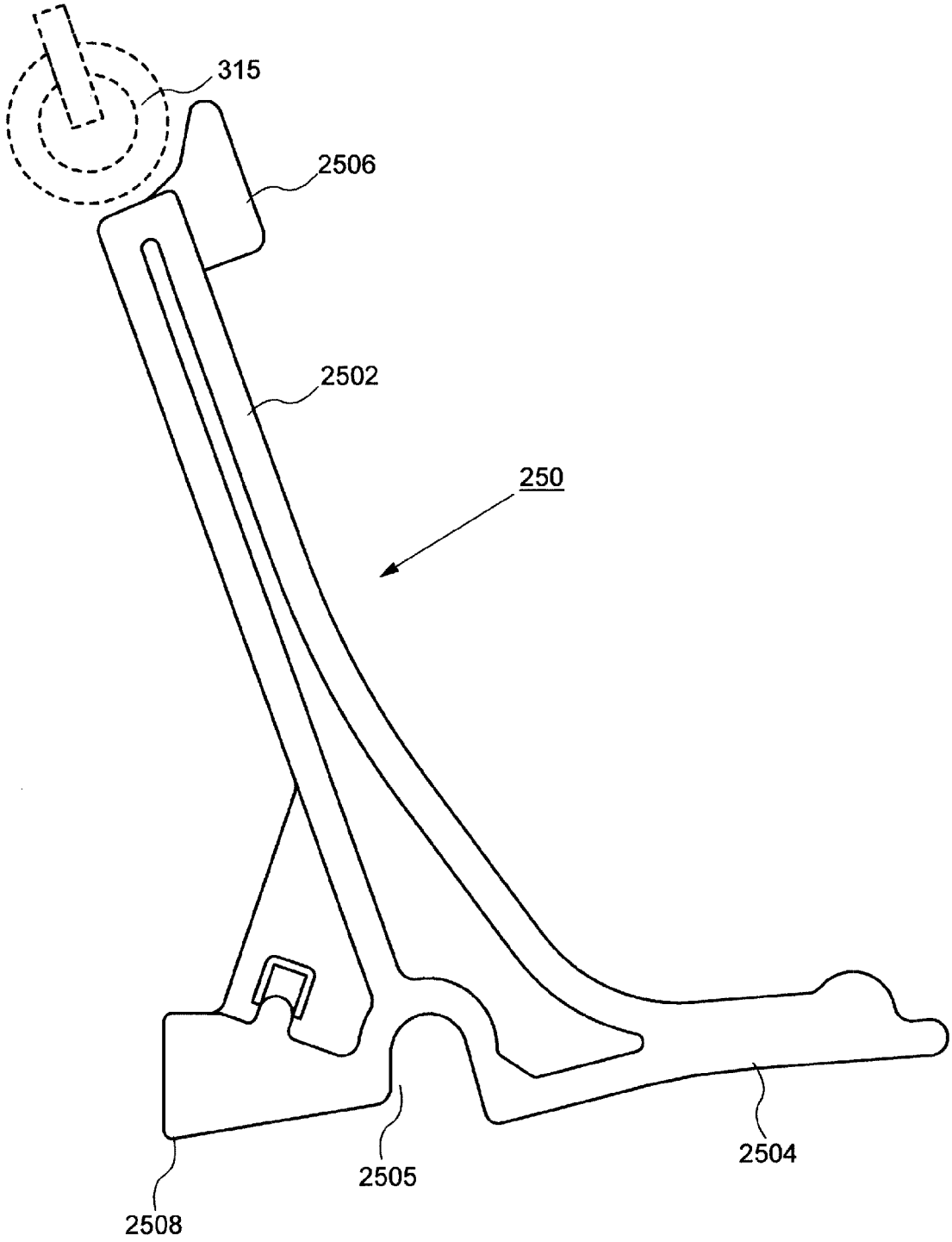
FIG. 4 is a side view depicting the structure of a jack according to one embodiment of the present invention.

FIG. 4 shows a mode in which the rib 2506 has a concave-shaped curved shape with respect to the hammer shank roller 315. In other words, the concave shape of the rib 2506 has a mode so as to be along the outer circumferential surface of the hammer shank roller 315. According to this shape, the rib 2506 can make contact with the hammer shank roller 315 along the shape of the hammer shank roller 315. With this, the large jack 2502 can stably make contact with the hammer shank roller 315.

Figure 5:
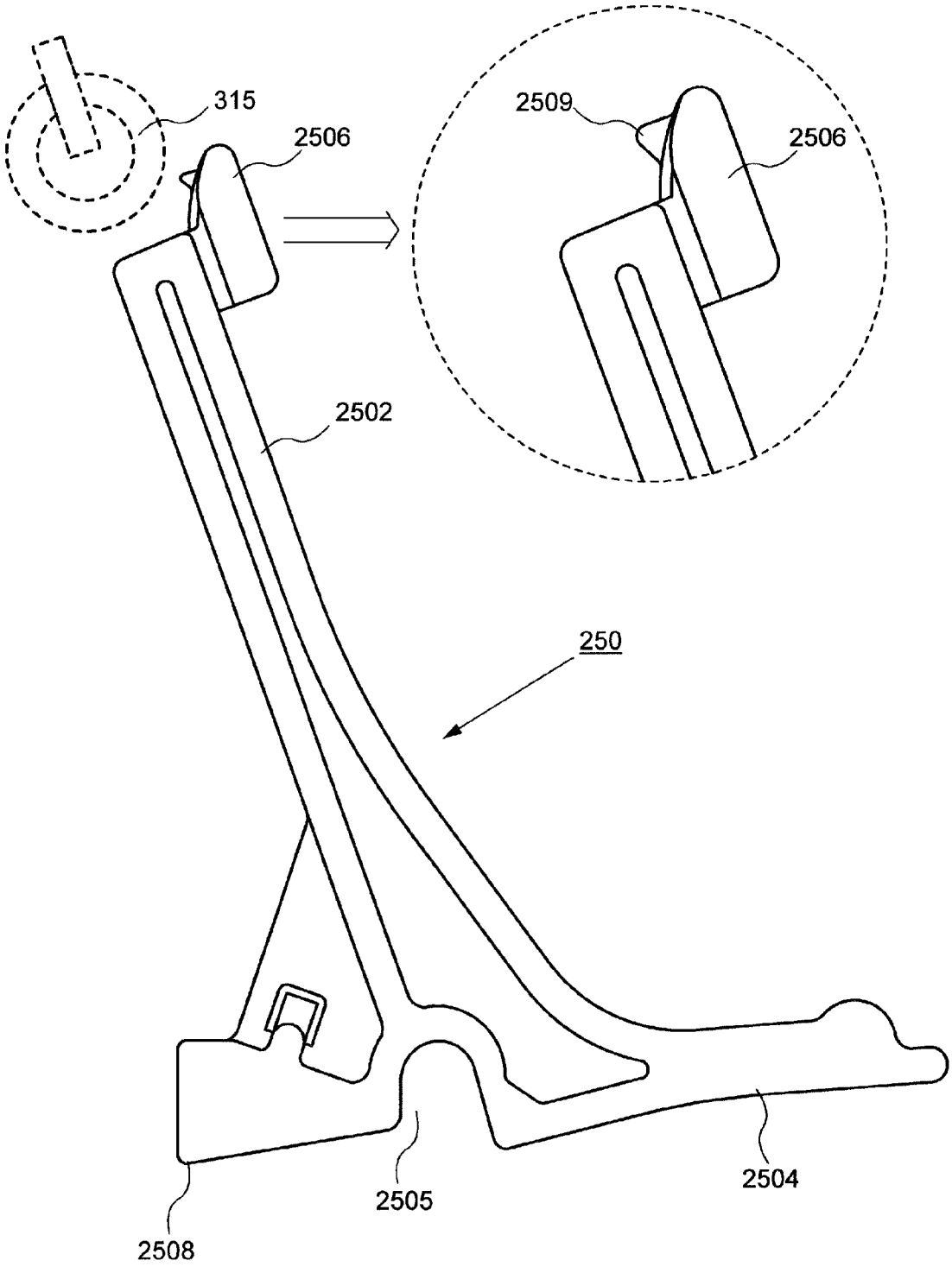
FIG. 5 is a side view depicting the structure of a jack according to one embodiment of the present invention.

FIG. 5 depicts another mode of the rib 2506. FIG. 5 depicts the mode in which a projection 2509 is provided on a plane where the rib 2506 makes contact with the hammer shank roller 315. In FIG. 5, as depicted in an enlarged view of the rib 2506 portion inserted in FIG. 5, the projection 2509 has a shape projecting from a front surface of the rib 2506. A preferred mode of the projection 2509 is such that the projection 2509 does not have a sharp tip but is formed in a curved surface. With this projection 2509 formed on the rib 2506, a contact area with the hammer shank roller 315 can be decreased. With this, friction between the rib 2506 and the hammer shank roller 315 can be reduced, and contact noise can also be reduced. The projection 2509 may be integrally formed with the rib 2506, or may be added as a separate component. The number of projections 2509 provided to the rib 2506 is not restricted to one, but a plurality of projections may be provided.

Note that the rib 2506 may be integrally formed with the jack 250. For example, when the jack 250 is a resin-made structure manufactured by injection molding or the like, the rib 2506 can be molded at one end of the large jack 2502 as a continuous shape. According to this mode, the number of components of the jack 250 can be reduced. Note that as a mode of a portion corresponding to the rib 2506 integrally molded with the jack 250, any of the modes depicted in FIG. 3, FIG. 4, and FIG. 5 can be applied.

In FIG. 2, in the torsion coil spring 280, the spring support portion 218 is taken as a fulcrum, the first arm 2802 makes contact with the spring contact portion 242, and the second arm 2804 makes contact with the spring contact portion 2562. The first arm 2802 functions as an elastic body which provides a rotational force to the repetition lever 240 via the spring contact portion 242 so as to move a player's side of the repetition lever 240 upward (in a direction away from the support 210). The second arm 2804 functions as an elastic body which provides a rotational force to the jack 250 via the spring contact portion 2562 so as to move the projecting portion 2508 downward (support 210 side).

As described above, according to one embodiment of the present invention, with the jack 250 having the rib 2506, the jack 250 is reliably positioned at a location where the hammer shank roller 315 makes contact with the jack 250. With this, even if the key is repeatedly pressed down at high speed (when the key is hit repeatedly), the hammer shank roller 315 can catch the jack 250, the jack 250 can be reliably positioned, and the operation of the support assembly 20 can be stabilized.

Operation of Support Assembly 20

Description is made to movement of the support assembly 20 when the key 110 in a state of being at the rest position (FIG. 1) is pressed down to the end position.

Figure 6:
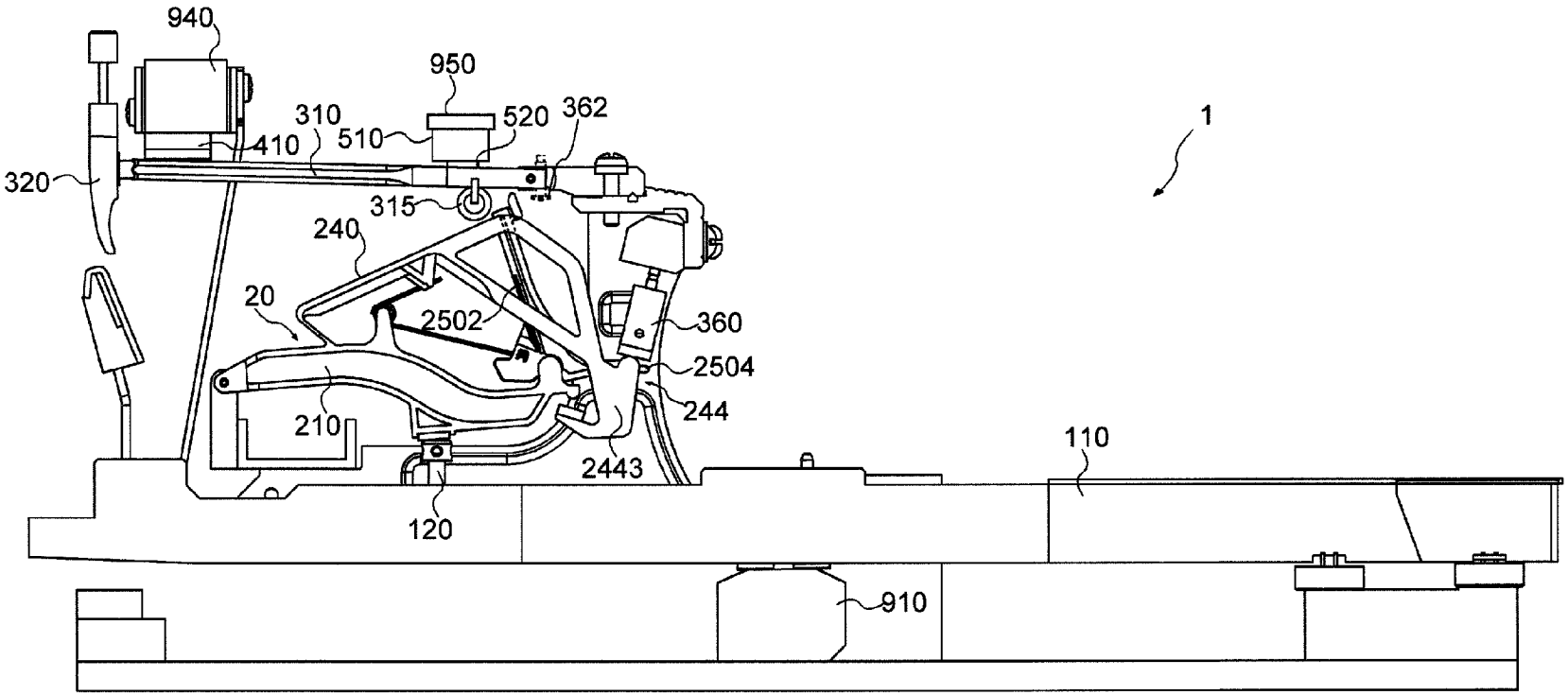
FIG. 6 is a side view for describing movement of a support assembly in one embodiment of the present invention.

FIG. 6 is a side view for describing movement of the support assembly 20 according to one embodiment of the present invention. When the key 110 is pressed down to the end position, the capstan screw 120 pushes up the support heel 212 to rotate the support 210, with the axis of the through hole 2109 taken as a rotation center. When the support 210 rotates to move upward, the large jack 2502 pushes up the hammer roller 315 to cause the hammer shank 310 to collide with the hammer stopper 410. Note that this collision corresponds to string hammering by a hammer in a conventional grand piano.

Figure 7A:
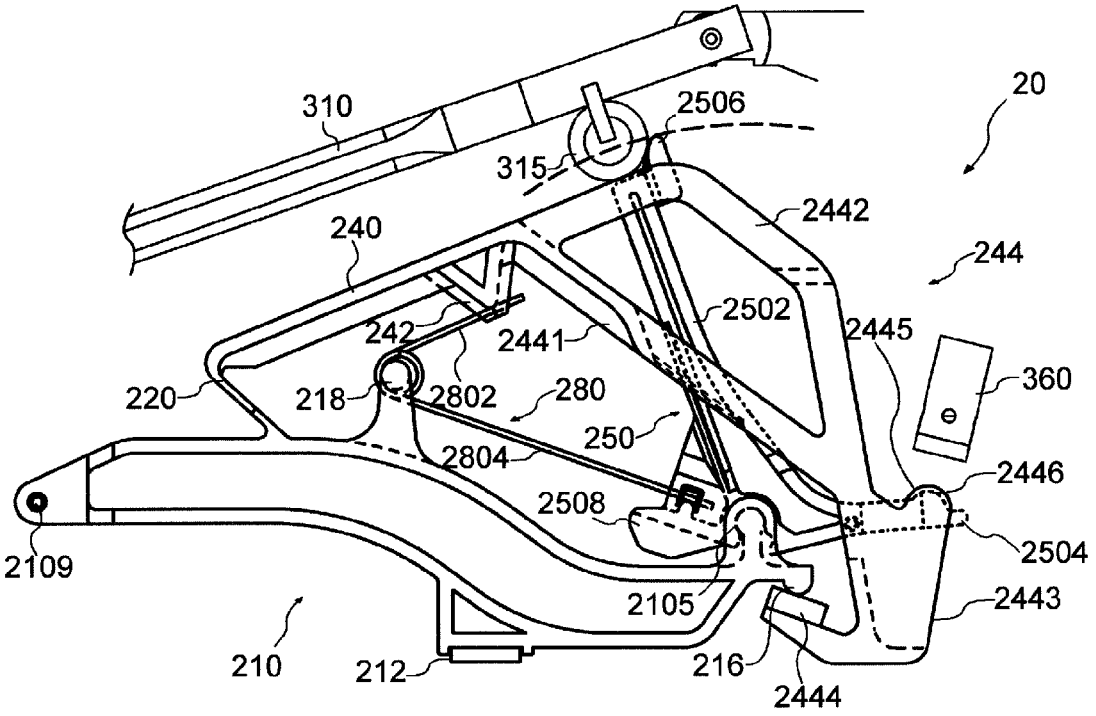
FIG. 7A is a side view for describing movement of the support assembly in one embodiment of the present invention.
Figure 7B:
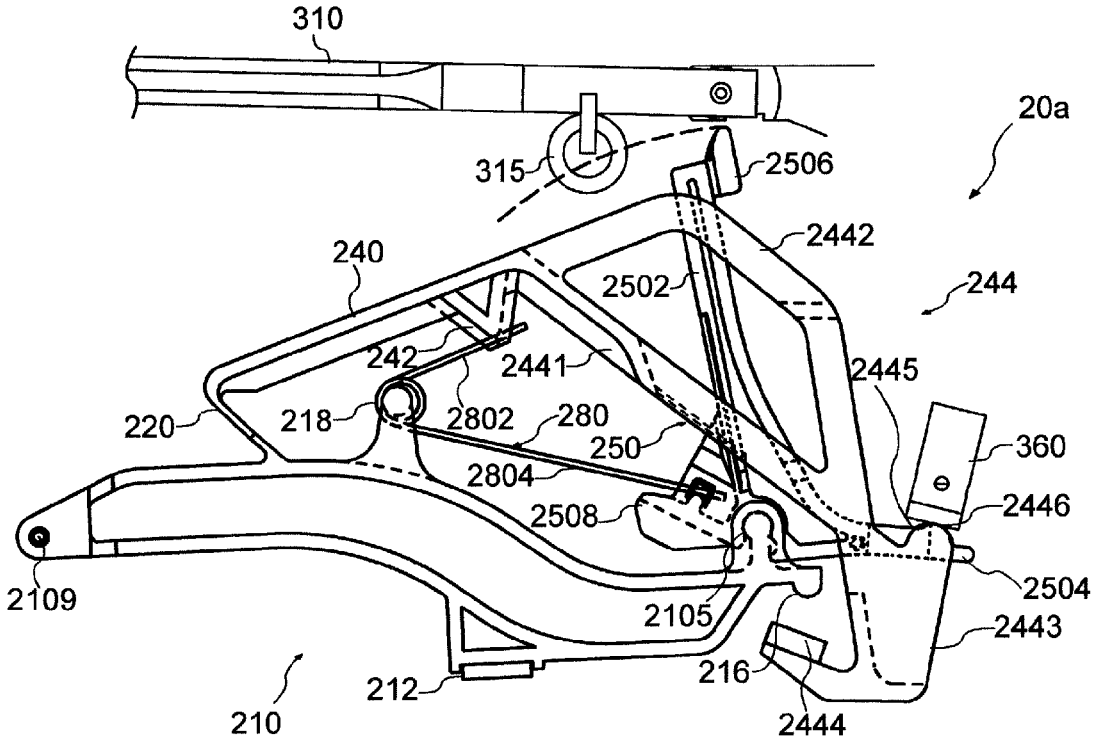
FIG. 7B is a side view for describing movement of the support assembly in one embodiment of the present invention.

The operation of the support assembly 20 at this time is depicted in FIG. 7A and FIG. 7B. FIG. 7A depicts a state of the support 210, the repetition lever 240, and the jack 250 before the key is pressed. In this state, the hammer shank roller 315 is supported by the repetition lever 240. The tip of the large jack 2502 on the other side overlaps the outer portion 2442 of the extension 244, and the rib 2506 projects upward from the outer portion 2442 to approach the hammer shank roller 315. The projecting portion 2508 provided to the jack 250 is held as being away from the support 210. In this state, the stopper contact portion 2444 in the extension 244 of the repetition lever 240 is held as making contact with the stopper 216 of the support 210. Here, a first contact portion 2445 of the coupling portion 2443 and a second contact portion 2446 of the small jack 2504 are away from the regulating button 360.

FIG. 7B depicts the state (operation state) the key is pressed. The support 210 rotates to cause a player's forward side to move upward. Immediately before the hammer shank 310 collides with the hammer stopper 410, the second contact portion 2446 of the small jack 2504 makes contact with the regulating button 360 to regulate upward rotation and further cause the support 210 (jack supporting portion 2105) to ascend. With the above-mentioned regulation of upward rotation and ascent of the jack supporting portion 2105, the large jack 2502 rotates so as to go off from the hammer shank roller 315. The repetition lever 240 rotates together with the support 210, and the first contact portion 2445 in the coupling portion 2443 makes contact with the regulating button 360 at the same timing as the second contact portion 2446. This regulates upward rotation of the repetition lever 240 to cause the repetition lever 240 to be displaced so as to approach the support 210. That is, with these operations, a double escapement mechanism is achieved. FIG. 6 is a drawing depicting this state. Note that when the key 110 is being returned to the rest position, the hammer shank roller 315 is supported by the repetition lever 240, and the large jack 2502 is returned below the hammer shank roller 315.

As described in FIG. 7A and FIG. 7B, by pressing the key, the support 210, the repetition lever 240, the jack 250, and the hammer shank 310 (also the accompanying hammer shank roller 315) each rotate on its rotation center. As for a detailed relation between the hammer shank roller 315 and the rib 2506, they are provided so that the rotation orbit of the rib 2506 provided to the large jack 2502 crosses within an operation range in which the hammer shank roller 315 rotates. With this, even if the jack 250 rotates on a rotation center side of the support 210, the provision of the rib 2506 can prevent the tip position of the large jack 2502 from falling into a depth side of the hammer shank roller 315. That is, the jack 250 after released can be prevented from passing through the position of the hammer shank roller 315 to return to the depth side. With this structure, even if the key is continuously pressed down, the operation of the above-described double escapement mechanism can be stabilized. At the time of key-releasing, the rib 2506 provided to the large jack 2502 on the other side is provided at a position contactable with the hammer shank roller 315 to stabilize the operation of the jack 250. To be held at a position where the upper end of the large jack 2502 makes contact with the hammer shank roller 315, the rib 2506 is preferably provided on the other side of the large jack 2502 at a portion opposite to the rotation center of the support 210.

Note that while the projecting portion 2508 does not make contact with the support 210 when the jack 250 is in a stationary state, the projecting portion 2508 has an action of regulating the rotation range when the large jack 2502 goes off from the hammer shank roller 315 after the key is pressed down and then, by the action of the coil spring 280, the key is returned to the previous position before the key is pressed down. Since the rib 2506 is provided at the position in contact with the hammer shank roller 315, the jack 250 can be stopped at an appropriate position with respect to the hammer shank roller 315. If the hammer 320 is away from the support assembly 20 at the time of key hammering, the rib 2506 does not make contact with the hammer shank roller 315 at the timing when the jack 250 returns. In this case, since the projecting portion 2508 is provided, excessive falling can be prevented. With the jack 250 supported by the projecting portion 2508 against falling, the hammer returned thereafter is returned by the hammer shank roller 315 to an appropriate position. In this manner, with the rib 2506 provided to the jack 250, the operation of the support assembly 20 can be stabilized. Note that while the present embodiment describes the mode in which both of the rib 2506 and the projecting portion 2508 are provided to the large jack 2502, the present invention is not restricted to this, and the rib 2506 may be provided to the jack 250 and the projecting portion 2508 may be omitted.

Sound Emission Mechanism of Keyboard Apparatus 1

As described above, the keyboard apparatus 1 is an example of application to an electronic piano. The operation of the key 110 is measured by the sensor 510, and a sound in accordance with the measurement result is outputted.

Figure 8:
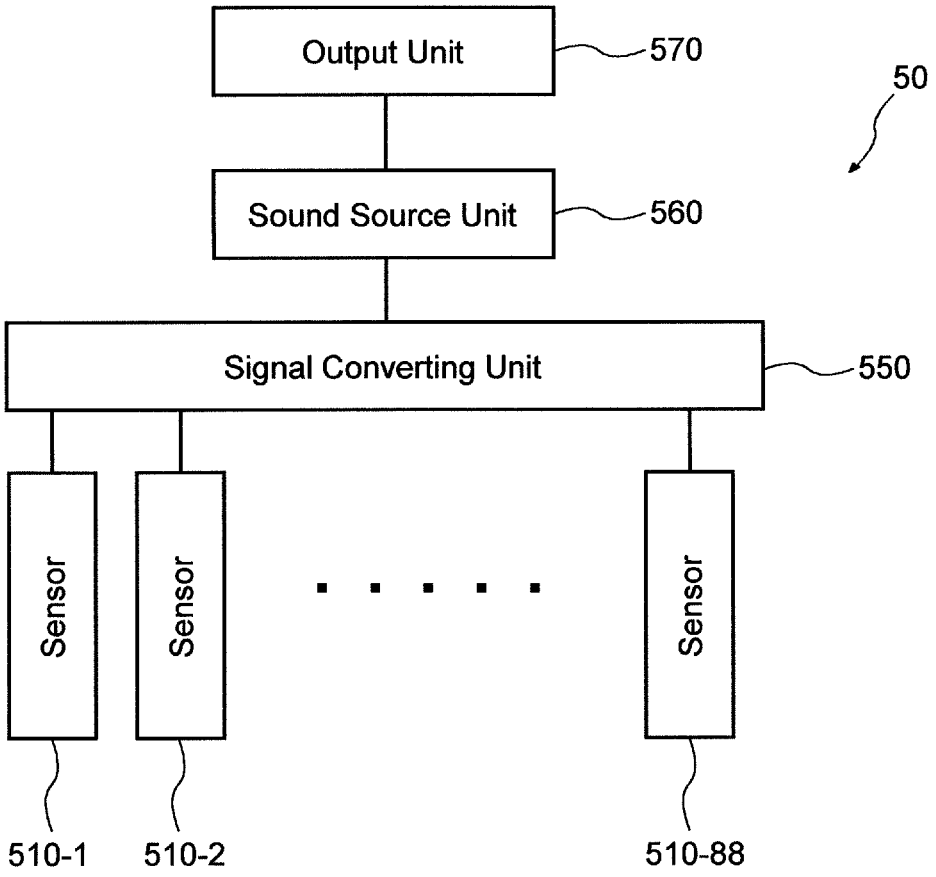
FIG. 8 is a block diagram depicting the structure of a sound emission mechanism of the keyboard apparatus in a first embodiment of the present invention.

FIG. 8 is a block diagram depicting the structure of a sound emission mechanism of the keyboard apparatus according to one embodiment of the present invention. A sound emission mechanism 50 of the keyboard apparatus 1 includes the sensors 510 (sensors 510-1, 510-2, . . . 510-88 corresponding to the eighty-eight keys 110), a signal converting unit 550, a sound source unit 560, and an output unit 570. The signal converting unit 550 obtains an electric signal outputted from the sensor 510, and generates and outputs an operation signal in accordance with an operating state in each key 110. In this example, the operation signal is a MIDI-format signal. Therefore, in accordance with the timing when the hammer shank 310 collides with the hammer stopper 410 by key-pressing operation, the signal converting unit 550 outputs Note ON. Here, a key number indicating which of the eighty-eight keys 110 has been operated and velocity corresponding to a speed immediately before the collision are also outputted in association with Note ON. On the other hand, when key-releasing operation is performed, in accordance with the timing when string vibrations are stopped by a dumper in the case of a grand piano, the signal converting unit 550 outputs the key number and Note OFF in association with each other. To the signal converting unit 550, a signal corresponding to another operation such as one on a pedal may be inputted and reflected to the operation signal. The sound source unit 560 generates a sound signal based on the operation signal outputted from the signal converting unit 550. The output unit 570 is a loudspeaker or terminal which outputs the sound signal generated by the sound source unit 560.

Second Embodiment

Structure of Keyboard Apparatus 2

A keyboard apparatus 2 in a second embodiment of the present invention is an example in which, as with the keyboard apparatus 1 of the first embodiment, an example of the support assembly according to the present invention is applied to an electronic piano. The keyboard apparatus 2 is similar to the keyboard apparatus 1, but is different in the support assembly and the support structure of the support assembly. Also, the keyboard apparatus 2 is different from the keyboard apparatus 1 in the method of regulating upward rotation of the repetition lever included in the support assembly. In the following description, description is made mainly on these different points, and description of common portions is omitted.

Figure 9:
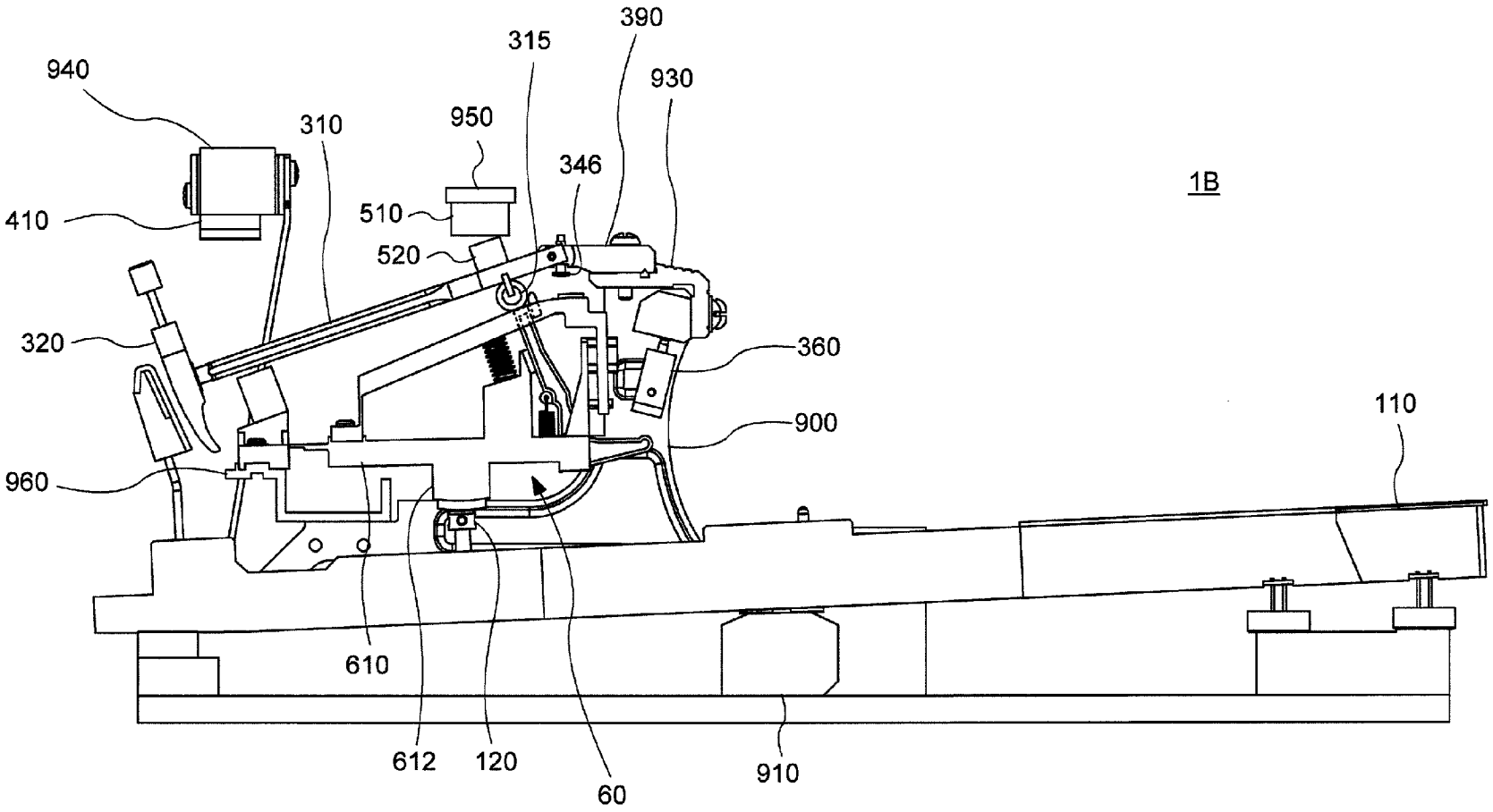
FIG. 9 is a side view depicting the structure of a keyboard apparatus in one embodiment of the present invention.

FIG. 9 is a side view depicting the structure of the keyboard apparatus in the second embodiment of the present invention. A support assembly 60 is fixed to a support rail 960. The support rail 960 is supported by a bracket 900. The support assembly 20 according to the first embodiment is rotatably supported with the shaft supported by the support flange 290 penetrating through the through hole 2109. On the other hand, while the support assembly 60 is similar in being rotatably supported by the support rail 960, but its support method is different as will be described further below. A repetition regulating screw 346 regulates upward (hammer shank 310 side) rotation of the support assembly 60. Note that the support rail 960 is an example of a frame serving as a reference of rotation of the support assembly 60. The frame may be formed of one member, such as the support rail 960, or may be formed of a plurality of members. The frame may be, as with the support rail 960, a rail-shaped member with a long side in the arrangement direction of the keys 110, or may be an independent member for each key 110.

Structure of Support Assembly 60

Figure 10:
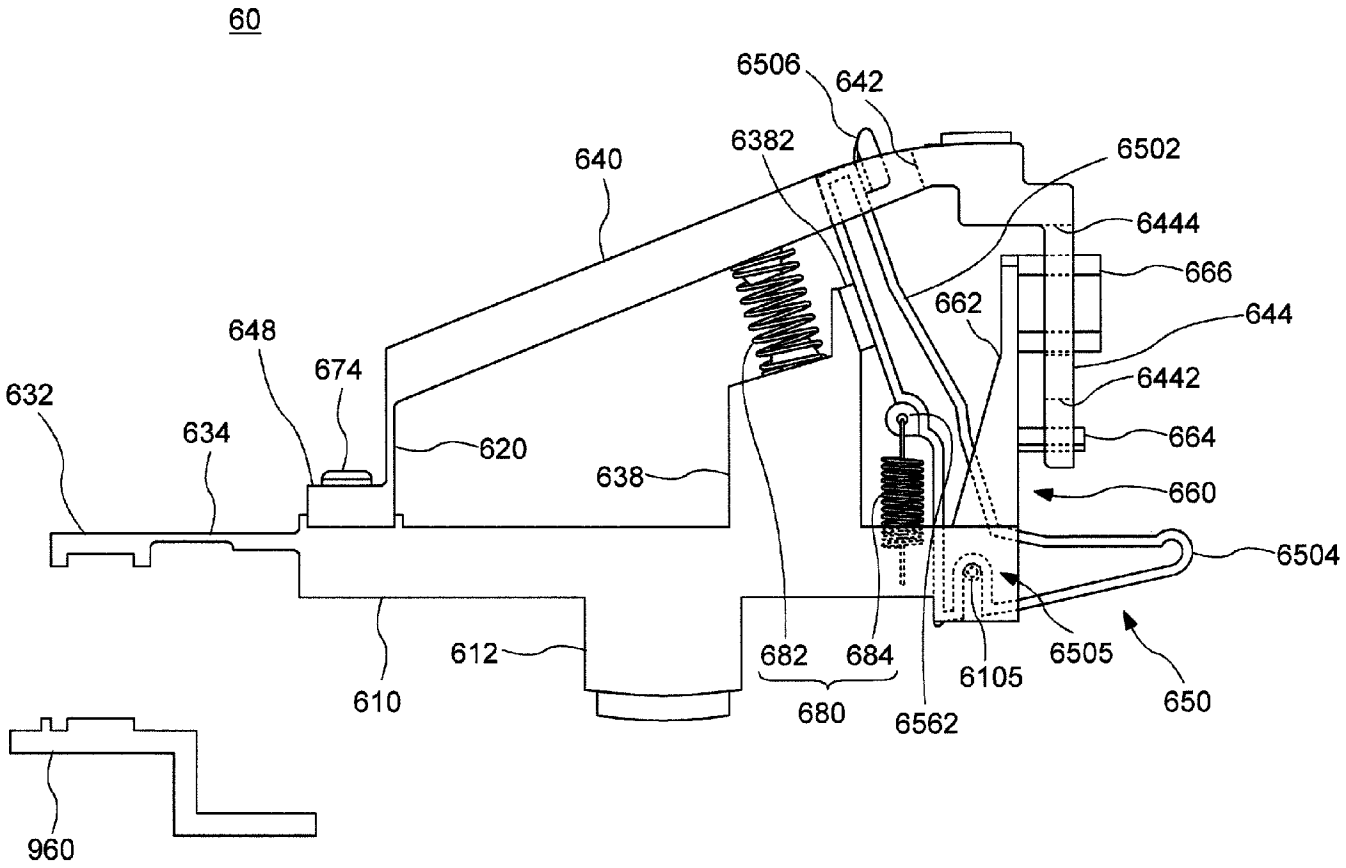
FIG. 10 is a side view depicting the structure of a support assembly according to one embodiment of the present invention.

FIG. 10 is a side view depicting the structure of the support assembly according to one embodiment of the present invention. The support assembly 60 of the keyboard apparatus 2 includes a support 610, a repetition lever 640, a jack 650, an operation regulating portion 660, and a coil spring 680. The support assembly 60, except the coil spring 680 and cushioning materials or the like (such as nonwoven fabric or elastic body) provided at a portion which collides with another member, is a resin-made structure manufactured by injection molding or the like.

The support 610 is rotatably supported with respect to the support rail 960. The repetition lever 640 is rotatably supported to the support 610. The jack 650 is rotatably disposed to the support 610. The jack 650 has a large jack 6502 and a small jack 6504, the large jack 6502 being disposed so as to be able to penetrate through a slit 642 provided in the repetition lever 640 and the small jack 6504 extending from the support 610 toward a player's forward side. Furthermore, the large jack 6502 has one end provided with a rib 6506. As with the first embodiment, the rib 6506 is provided at a position contactable with the hammer shank roller 315. Also, the operation regulating portion 660 is disposed on a repetition lever 640 side of the support 610.

The support 610 has a support heel 612, a frame fixing portion 632, a flexible portion 634, and a base 638. The frame fixing portion 632 fixes the support 610 to the support rail 960. The flexible portion 634 is provided between the support 610 of each support assembly 60 and the frame fixing portion 632 and has flexibility (elasticity). Also, the flexible portion 634 is integrally formed with the support 610 and the frame fixing portion 632, and has a plate thickness thinner than at least that of the support 610 in a rotating direction of the support assembly 60 or a plate thickness direction of the flexible portion 634. Note that while the structure is illustrated in FIG. 10 in which the support 610, the frame fixing portion 632, and the flexible portion 634 are integrally formed, the present invention is not restricted to this. For example, the flexible portion 634 may be fixed to one or both of the support 610 and the frame fixing portion 632 by a fixture, adhesive, welding, or the like. Here, the flexible portion 634 serves as a rotation center of the support assembly 60.

The base 638 is connected to a repetition lever 640 side of the support 610. On an upper surface (repetition lever 640 side) of the base 638, a coil spring 682 acting on the base 638 and the repetition lever 640 and a large-jack stopper 6382 which regulates the rotation of the jack 650 in a direction in which the large jack 6502 approaches the base 638 are provided. The coil spring 682 is a compression spring which acts on the base 638 and the repetition lever 640 in a direction in which the base 638 and the repetition lever 640 go away from each other and functions as an elastic body which provides a rotational force to the repetition lever 640. Between the large-jack stopper 6382 and the large jack 6502, a cushioning material or the like (such as nonwoven fabric or elastic material) may be provided to reduce noise occurring due to a contact between the large-jack stopper 6382 and the large jack 6502.

The repetition lever 640 has a flexible portion 620, a slit 642, an extension 644, and a support fixing portion 648. The flexible portion 620 extends to a support 610 side of the repetition lever 640, and is coupled to the support fixing portion 648. That is, the flexible portion 620 is provided between the repetition lever 640 and the support fixing portion 648. While the flexible portion 620 is integrally formed with the support fixing portion 648 and the repetition lever 640, since the plate thickness of the flexible portion 620 is thinner than the plate thickness of the repetition lever 640, the flexible portion 620 has flexibility (elasticity). Therefore, the repetition lever 640 rotates by taking the flexible portion 620 as a center.

The slit 642 is provided at a position where the large jack 6502 can penetrate through, on part of the player's forward side of the flexible portion 620 as the rotation center of the repetition lever 640. The extension 644 is coupled to a support 610 side of the repetition lever 640 on a jack 650 side of the flexible portion 620 as the rotation center of the repetition lever 640. Also, the extension 644 has slits 6442 and 6444. The support fixing portion 648 is fixed to the support 610 by a fixture 674.

Note that while the structure is illustrated in FIG. 10 such that the repetition lever 640, the flexible portion 620, and the support fixing portion 648 are integrally formed, the present invention is not restricted to this. For example, the flexible portion 620 may be fixed to one or both of the repetition lever 640 and the support fixing portion 648 by a fixture, adhesive, welding, or the like.

With the support connecting portion 6505 between the large jack 6502 and the small jack 6504 being connected to the jack support portion 6105, the jack 650 is rotatably disposed with respect to the support 610. To part of the large jack 6502, a spring contact portion 6562 to which a coil spring 684 is connected is provided. The coil spring 684 is a tension spring which acts on the large jack 6502 and the support 610 in a direction in which the large jack 6502 approaches the base 638 and functions as an elastic body which provides a rotating force to the jack 650.

The support 610 includes two plate-shaped members for interposition from sides of both side surfaces of the jack support portion 6105 on a player's forward side of the base 638. Between these two plate-shaped members, the support connecting portion 650 and part of the coil spring 684 are provided. In at least part of a space interposed between these two plate-shaped members, the jack 650 and the support 610 may slidably make contact with each other to decrease yawing and rolling of the jack 650.

The operation regulating portion 660 is provided opposite to the flexible portion 634 with reference to the flexibly portion 620. Also, the operation regulating portion 660 has an extension 662, a stopper 664, and a guide 666. The extension 662 is disposed on a repetition lever 640 side of the support 610. The stopper 664 and the guide 666 are disposed to the extension 662, and each extend from the extension 662 to a player's forward side. In other words, the stopper 664 and the guide 666 can be said as an extension extending from the extension 662 to the player's forward side. The stopper 664 penetrates through the slit 6442 provided in the extension 644, and the guide 666 penetrates through the slit 6444 provided in the extension 644. Note that the slits 6442 and 6444 may have any shape as long as the stopper 664 and the guide 666 can engage therewith and, for example, the shape may be provided with a groove where the stopper 664 and the guide 666 can engage. The slits 6442 and 6444 can be said as engaging portions.

The support assembly 60 is similar in the operation mechanism to that described in the first embodiment, although the support 610, the repetition lever 640, the jack 650, the coil spring 680, and so forth are different. When attention is focused on the jack 650, the rib 6506 has an action of regulating, together with the large-jack stopper 6382, the rotation of the jack. For example, the rib 6506 makes contact with the hammer shank roller 315 to regulate the rotation range of the jack 650, and the large-jack stopper 6382 may be provided as an auxiliary member which further regulates the rotation of the jack 650. With the rib 6506 provided at a position of making contact with the hammer shank roller 315, the jack 650 can be stopped at an appropriate position with respect to the hammer shank roller 315. If the hammer 315 is away from the support assembly 60 at the time of key hammering, the rib 6506 does not make contact with the hammer shank roller 315 at the timing when the jack 650 returns. In this case, since the projection 6508 is provided, excessive falling can be prevented. With the jack 650 supported by the projection 6508 against falling, the hammer 320 returned thereafter is returned by the hammer shank roller 315 to an appropriate position. In this manner, with the rib 6506 provided to the jack 650, the operation of the support assembly 60 can be stabilized. Note that while the present embodiment describes the mode in which the rib 6506 is provided to the large jack 6502 and the large-jack stopper 6382 is provided to the upper surface of the base 638, the present invention is not restricted to this, and similar operations and effects can be obtained even if the rib 6506 is provided to the jack 650 and the large-jack stopper 6382 is omitted.

According to one embodiment of the present invention, in the support assembly, a rib is provided to a jack at a position contactable with the hammer shank roller. With this, the operation of the jack can be stabilized. Also, with this structure, the number of components in the support assembly is reduced, and manufacturing costs can be reduced.

In the above-described first and second embodiments, an electronic piano is described as an example of a keyboard apparatus to which a support assembly is applied. However, the present invention is not restricted to this, and the support assembly disclosed in the above embodiments can also be applied to a grand piano (acoustic piano) and a keyboard apparatus with an action mechanism similar to this. In the case the large jack 2502 is returned below the hammer roller 315 after string hammering by the hammer, the repetition lever 240 may be omitted. For example, the keyboard apparatus 1 may have a structure whereby when the key 110 is returned to the rest position a part of the hammer assembly is supported by another member instead of the repetition lever 240 and the large jack 2502 is returned below the hammer roller 315.

What is claimed is:

1. A support assembly of a keyboard apparatus activated in accordance with pressing of a key to rotate a hammer provided at one end of a hammer shank, the support assembly comprising:

a support rotatably disposed with respect to a frame; and a jack rotatably disposed with respect to the support and having one end including a rib which makes contact with a hammer shank roller provided to the hammer shank.

2. The support assembly according to claim 1, wherein the rib is provided on the other side of the jack opposite to a rotation center of the support.

3. The support assembly according to claim 1, wherein the rib has a contact surface in a curved shape on the hammer shank roller side.

4. The support assembly according to claim 3, wherein the curved shape is a convex shape.

5. The support assembly according to claim 3, wherein the curved shape is a concave shape.

6. The support assembly according to claim 1, wherein the rib has a contact surface on the hammer shank roller side, the contact surface being provided with a projection.

7. The support assembly according to claim 1, wherein a projection which rotates together with the jack is provided on the one side of the jack.

8. The support assembly according to claim 7, wherein the projection is away from the support when the jack is in a stationary state.

9. A keyboard apparatus comprising:

support assemblies each activated in accordance with pressing of a key to rotate a hammer provided at one end of a hammer shank; and keys disposed correspondingly to the respective support assemblies, each of the support assemblies including a support rotatably disposed with respect to a frame, and a jack rotatably disposed with respect to the support and having one end including a rib which makes contact with a hammer shank roller provided to the hammer shank.

10. The support assembly according to claim 9, wherein the rib is provided on the other side of the jack opposite to a rotation center of the support.

11. The support assembly according to claim 9, wherein the rib has a contact surface in a curved shape on the hammer shank roller side.

12. The support assembly according to claim 11, wherein the curved shape is a convex shape.

13. The support assembly according to claim 11, wherein the curved shape is a concave shape.

14. The support assembly according to claim 9, wherein the rib has a contact surface on the hammer shank roller side provided with a projection.

15. The support assembly according to claim 9, wherein a projection which rotates together with the jack is provided on the one side of the jack.

16. The support assembly according to claim 15, wherein the projection is away from the support when the jack is in a stationary state.

17. The support assembly according to claim 1, wherein the rib is provided over a contact surface and projects in a direction to a hammer shank roller side.

* * * * *